US006022380A

United States Patent [19]

Satoh

[11] Patent Number: 6,022,380

[45] Date of Patent: Feb. 8, 2000

[54] PROCESSES FOR MANUFACTURING COLORED HAIR USING COLOR SIZING AGENTS AND VAPOR

[75] Inventor: Toshihiko Satoh, Niigata-ken, Japan

[73] Assignee: Aderans Co., Ltd., Tokyo, Japan

[21] Appl. No.: 09/126,764

[22] Filed: Jul. 31, 1998

[30] Foreign Application Priority Data

Mar. 3, 1998 [JP] Japan ..... 10-050932

[51] Int. Cl.[7] ..... A61K 7/13

[52] U.S. Cl. ..... 8/405; 8/469; 8/495; 8/506; 132/201; 132/208

[58] Field of Search ..... 8/405, 431, 467, 8/469, 495, 512, 516, 517; 132/201, 208, 221, 227, 228

[56] References Cited

U.S. PATENT DOCUMENTS

| | | | |
|---|---|---|---|
| 3,437,095 | 4/1969 | Scott et al. | 132/208 |
| 4,166,473 | 9/1979 | Bauer et al. | 132/272 |
| 4,672,983 | 6/1987 | Nath et al. | 132/208 |
| 4,942,893 | 7/1990 | Trottier | 132/208 |
| 5,056,538 | 10/1991 | Matula | 132/208 |
| 5,104,413 | 4/1992 | Ikeda | 8/405 |
| 5,469,377 | 11/1995 | Samain et al. | 8/405 |
| 5,595,197 | 1/1997 | Samain et al. | 132/208 |
| 5,823,204 | 10/1998 | Todd | 132/208 |
| 5,860,431 | 1/1999 | Abercrombie et al. | 132/208 |

FOREIGN PATENT DOCUMENTS

| | | |
|---|---|---|
| 1-174683 | 7/1989 | Japan . |
| 9-67725 | 3/1997 | Japan . |

*Primary Examiner*—Caroline D. Liott
*Attorney, Agent, or Firm*—Armstrong Westerman Hattori McLeland & Naughton

[57] ABSTRACT

A process for manufacturing colored hair is disclosed. This process comprises the steps of applying a color sizing agent to hair material, semi-drying the color sizing agent applied to the hair material, winding a vapor feeding member comprised of a net member and a moisture-containing member around an area of the hair material where the color sizing agent is applied, winding an evaporation adjusting member for adjusting the quantity of evaporation of the moisture around the vapor feeding member from outside thereof, and permeating and fixing the color sizing agent to the applied area of the hair material by heating the vapor feeding member, thereby, hair at least partly applied with a desired color or color shade is obtained. A colored hair obtained by the above process is also disclosed.

19 Claims, 6 Drawing Sheets

PROCESSES FOR MANUFACTURING COLORED HAIR USING COLOR SIZING AGENTS AND VAPOR

BACKGROUND OF THE INVENTION

This invention relates to a process for manufacturing colored hair, and colored hair thus manufactured. Such colored hair can be utilized as hair for implanting in a wig, or as hair to be joined to natural hair to thicken the hair on the head of a person who needs more hair. The colored hair of this type can also be utilized as false hair (as a hair accessory) applied with plural or various colors. A strand of hair may be, entirely or partly, applied with a color or colors, so that any degree of fashion may be enjoyed.

Generally, the colors or color shades(tones) of the hair on a person's head differ among individuals. The hair color of Orientals such as Japanese, Chinese, etc., has a basic shade of black. The color black itself varies from person to person ranging from dark black to various tones of blue, brown and red. On the other hand, the hair color of Caucasians such as Europeans and Americans exhibits a wider range of colors including black, such as blond, blue, red, etc. Also, regardless of a persons ethnic back ground, the color of a person's hair becomes darker (or deeper) at the scalp and lighter in color towards the tip. For this reason, hair materials used for wigs, hair-thickening members, and the like are preferably selected from the colors and color shades more closely matched with the hair on a person's head, in order to give a more natural look. This is also important from the view point that a wig on a person's head is not easily noticed.

Recently, it has become fashionable that the hair on a person's head as a whole is dyed in plural or various colors, or a part of the hair such as, for example, only the hair on the forehead portion and/or the side-head portion is applied with a different color or colors from the natural color of his/her own hair, or a portion of hair is applied with a different color or colors, or in a strand of hair, for example, a root portion of hair is applied with red, an intermediate portion, with brown, and so forth, so that a desired fashion of hair can be achieved. In such cases, if the attachment hair applied with plural or various colors could be used without the trouble of dyeing one's hair, the intended purpose could apparently be achieved more easily.

In general, the hair on a human head is so thin approximately 0.05 to 0.08 mm in diameter on average. For this reason, the hair material to be normally used in a wig or the hair thickening material, or the attachment hair for hair accessory is also as thin in diameter as human hair. In hair material such as this, it is commonly known that artificial hair can be obtained by processing such synthetic resin fiber as nylon, modacryl, polyester, and the like, as well as natural human hair. When these hair materials are dyed, difficulties are accompanied in applying a color or colors to such thin hair material approximately 0.05 to 0.08 mm in diameter in order to achieve the desired look, having a predetermined color and/or color shade in accordance with the desire of the individual. Moreover, it is absolutely necessary for such colored hair material not to be changed easily in color or not to fade easily even when exposed to the sun light or even when washed. In addition, the required minimum rigidity is necessary.

Difficulties are also encountered when a part of a single strand of hair material is applied with a different color or color shade from the rest. In addition, an excessively complicated procedure is needed for applying two or more different colors by dividing a single strand of hair material into two or more parts. The following steps are made in order to obtain desired color.

One example disclosed in the Japanese Patent Unexamined Publication (KOKAI) No. 174683/89; artificial hair whose single strand of hair has different colors or color shades is obtained through a dipping process in which a part of hair material formed of colored synthetic fiber is dipped into a dyeing liquid having a different color or color shade from that of the hair material several times.

In another example disclosed in the Japanese Patent Unexamined Publication (KOKAI) No. 67725/97; after a multifilament formed of a monofilament having a single yarn size of 5 to 100 denier is twisted at 200 times/m or less, regular loop-like crimps are applied therewith through a knitting/deknitting process, and then a knitting fabric on an intermediate stage of the knitting/deknitting process is intermittently applied with a color(s) in accordance with a space dyeing process and thereafter deknitted.

However, in the dipping technique discussed in the above Japanese Patent Unexamined Publication (KOKAI) No. 174683/89, when only a part of the hair material is dyed, only that part to be dyed must be kept dipped in the dyeing liquid of a dyeing vessel for a predetermined time and special attention must be paid so that the rest of the hair material, not to be dyed, will not accidentally be dipped in the dyeing liquid. In this process, when, for example, a central portion of the hair material is to be dyed by 5 cm, only this part of the hair material must be dipped in the dyeing liquid of the dyeing vessel precisely for a predetermined time. Since it is required to correctly hold the hair material so that the part of the hair material, not to be dyed, will not accidentally be dipped in the dyeing liquid, the adjustment for precisely applying a color to the predetermined part of the hair material is difficult. Moreover, when various or plural colors or color shades are to be separately applied to the hair material, it becomes necessary to dip the determined part of the hair to be dyed into the dyeing color vessel whenever such an application is made, and therefore, the number of processes is increased. Thus, this dipping process is difficult to be applied in a case where partial coloring is required or where a single strand of hair is required to be applied with two or more colors or color shades.

In the example discussed in the above Japanese Patent Unexamined Publication (KOKAI) No. 67725/97, this technique cannot be applied to straight hair and the processes are complicated, since the employment of this technique is too difficult.

The present invention has been accomplished in order to solve the above problems inherent in the conventional techniques.

SUMMARY OF THE INVENTION

It is, therefore, an object of the present invention to provide a process for manufacturing colored hair, and a colored hair thus manufactured, in which hair material as a head accessory can easily be applied with a color or colors, and a desired part of a single strand of hair is applied with a different color or colors from the original color of the hair material, or parts of a single strand of hair such as, for example, a basal portion, a central portion, and a distal portion, can be applied with different colors respectively, in a comparatively easy manner.

In order to achieve the above object, from the first aspect of the present invention, there is essentially provided a process for manufacturing colored hair comprising the steps of; applying a color sizing agent to the hair material; semi-drying the color sizing agent applied to the hair material; winding a vapor feeding member comprised of a net member and a moisture-contained member around an area of the hair material where the color sizing agent is applied; winding an evaporation adjusting member for adjusting the quantity of evaporation of the moisture around the vapor feeding member from outside, thus permeating and fixing the color sizing agent to the applied area of the hair material by heating the vapor feeding member; thereby, hair at least partly applied with a desired color or color shade will be obtained.

It is preferred that the hair material consists of artificial hair made of synthetic fiber such as nylon, modacryl, polyester or the like, human hair, or mixed hair thereof, plural strands of the hair material cut into a proper length dimension are placed in juxtaposed relation, then, a central portion of the plural strands of the hair material thus juxtaposed is sewn into a hair bundle, and then, a color sizing agent is applied thereto.

It is also preferred that the color sizing agent contains 30% by weight of aqueous solution of DL-malic acid, and the DL-malic acid is contained in the color sizing agent at a ratio of 1.2% by weight.

It is preferable that when a color sizing agent is applied to the hair material, a screen board having a window is used, and the color sizing agent is applied to a predetermined area of the hair material through a fine mesh formed in the window.

It is also preferable that the mesh formed in the window of the screen board is 1.6 to 2.3 $mm^2$ per opening in each mesh.

It is also preferable that the net member of the vapor feeding member is separately constructed from the moisture-contained member located outside thereof.

It is also preferable that the net member of the vapor feeding member is integrated with the moisture-contained member located outside thereof, by sewing, bonding, or the like.

It is also preferable that the net member is formed of synthetic resin fiber which is 0.1 to 0.15 mm in thickness and 0.25 to 4.0 $mm^2$ per opening in each mesh.

It is also preferable that the moisture-contained member is formed of a nonwoven fabric sheet, a paper sheet, a water absorptive synthetic resin sheet, or a water absorptive natural fiber interwoven sheet, and the sheet contains moisture.

It is also preferable that the evaporation adjusting member is formed of a film-like aluminum foil or a synthetic resin thin sheet, and the evaporation adjusting member is firmly wound around the vapor feeding member, which covers the color sizing agent applied area of the hair material, from outside thereof, with opposite ends thereof opened.

It is also preferable that when the dye of the color sizing agent is permeated and fixed to the applied area of the hair material, a heat shielding material is wound around the hair material as a whole from outside the evaporation adjusting member, and thereafter, the hair material as a whole is heated.

It is also preferable that the heat shielding material is a nonwoven fabric or paper.

It is also preferable that a plurality of spaced sections from the basal end to the distal end of the hair material is subjected to dyeing treatment with the use of the color sizing agent.

It is also preferable that the central portion of the hair material is dyed in the same color as either the base of a wig or a scalp by applying the color sizing agent thereto, so that the central portion of the hair material which is to be secured to the wig base or scalp, is camouflaged.

From the second aspect of the present invention, there is essentially provided a process for manufacturing colored hair comprising the steps of applying a color sizing agent to a transfer sheet and drying the same; enclosing an area of hair material to be subjected to a color treatment with an area of the transfer sheet where the color sizing agent is applied; and permeating and fixing the dye in the color sizing agent to the hair material by heating the color sizing agent applied area from the top of the transfer sheet under evaporation; by doing so, hair at least partly applied with a desired color or color shades being obtained.

It is preferable that the color sizing agent contains 30% by weight of aqueous solution of DL-malic acid, and the DL-malic acid is contained in the color sizing agent at a ratio of 1.2% by weight.

It is also preferable that when the color sizing agent is applied to the transfer sheet, a screen board having a window is used, and the color sizing agent is applied to the transfer sheet through a fine mesh formed in the window.

It is also preferable that the mesh formed in the window of the screen board is 1.6 to 2.3 $mm^2$ per opening in each mesh.

It is preferred that the hair material is dyed, either wholly or partly, with use of the color sizing agent.

It is also preferred that the hair material is partly dyed in a plurality of different colors or color shades with the use of the color sizing agent.

From the third aspect of the present invention, there is essentially provided a colored hair manufactured by applying a color sizing agent to hair material, semi-drying the color sizing agent applied to the hair material, thereafter winding a vapor feeding member comprised of a net member and a moisture-contained member around an area of the hair material where the color sizing agent is applied, winding an evaporation adjusting member for adjusting the quantity of escaping evaporation around the vapor feeding member from outside thereof, and permeating and fixing a dyeing material by heating the hair material after the hair material as a whole being wound with a heat shielding material.

When the color sizing agent is applied to the hair material, a screen board having a window is preferably used, and the color sizing agent is applied to the hair material through a fine mesh formed in the window.

From the fourth aspect of the present invention, there is essentially provided a colored hair manufactured by applying a color sizing agent to a transfer sheet and drying the same, enclosing a hair material to be subjected to color treatment with an area of the transfer sheet where the color sizing agent is applied, and permeating and fixing the color sizing agent to the hair material by heating the applied area from above the transfer sheet under evaporation.

It is preferable that the colored hair is manufactured by using a screen board having a window when the color sizing agent is applied to the transfer sheet, and applying the color sizing agent to the transfer sheet through a fine mesh formed in the window.

It is also preferable that the colored hair is manufactured by applying the color sizing agent to the hair material, either wholly or partly.

It is preferred that the hair material is partly dyed in a plurality of different colors or color shades with the use of the color sizing agent.

In the process for manufacturing a colored hair from the first aspect of the present invention, the entire hair material or only a desired part of the hair material where a color is to be applied is applied with a color sizing agent, then the applied area is wound by a vapor feeding member comprised of a net member and a moisture-contained member before the agent is completely dried, and then the same is subjected to heat treatment by steam, so that the dye in the color sizing agent is permeated and fixed into the hair material. Accordingly, the hair material can easily be dyed in a series of small steps.

According to the present invention, particularly, in the case different colors and color shades are applied to various sections of a single strand of hair material, for example, a root portion, an intermediate portion, and a distal portion of the hair material is applied with red, brown, and yellow, respectively, merely by applying those color sizing agents to the respective sections of the hair material and heating them by steam after the application of the color sizing agents is completed, the permeating and fixing steps of the red, brown and yellow dyes into a predetermined section of the hair material, namely, the root portion, the central portion, and the distal portion can be completed in one step. Accordingly, the number of working steps can be reduced extensively compared to the conventional permeating process discussed above.

Furthermore, according to the present invention, since colored hair can be obtained merely by applying a color to a desired part of the hair material and then permeating and fixing the same, a plurality of colors and color shades can be exhibited extremely easily in a single strand of hair without the need of an extravagant process.

Furthermore, color can be precisely applied to a predetermined area of the hair material through the color application treatment of the present invention, and in addition, production can easily be met, regardless of the demand i.e. from one to any number.

In the present invention, single or multi colors can be applied to each strand of hair, or a single strand of hair can be treated with different color shades, for example, from its basal portion towards its distal portion. Accordingly, a dramatic effect can be obtained by implanting the colored hair of the present invention into a wig or a hair thickening material, or by utilizing the colored hair of the present invention in its place.

Moreover, in the case when colored hair thus obtained by the present invention is implanted in the base of a wig, the knot portion of the hair can be camouflaged simply by applying a color of a less-conspicuous color tone such as, white or skin color, to the basal portion of the colored hair which is located on the knot portion in respect to the base of the wig.

The present invention will become more fully understood from the detailed description given hereinbelow and the accompanying drawings which are given by way of illustration only, and thus are not limited to what is described here.

DETAILED DESCRIPTION OF THE EMBODIMENTS

Figure 1:
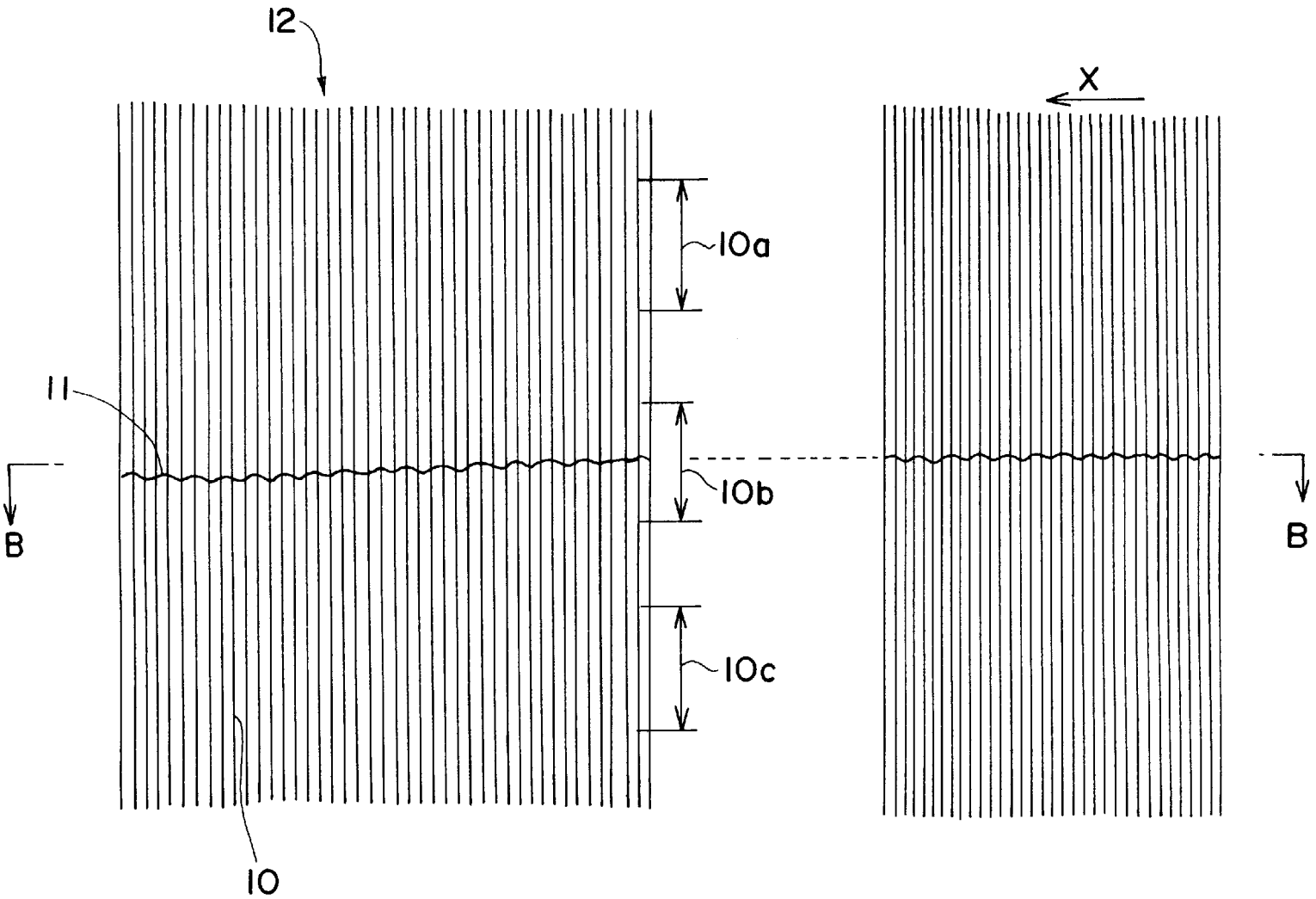
FIG. 1 is a plan view, partly omitted, showing a hair bundle of the hair material used in a process for manufacturing a colored hair according to the present invention.

The present invention will be described hereinafter in detail based on the embodiments illustrated in the drawings. Identical members are denoted by identical reference numerals throughout the drawings.

In a process for manufacturing a colored hair according to the present invention, only hair materials are preferably bundled and a portion thereof is connected together, subjected to color treatment. A dye is used for coloring the hair material. The dye to be used is mixed with either a natural or synthetic sizing agent, a carrier agent, and water in order to increase the viscosity of the color sizing agent. In application of the dye included color sizing agent to the hair material, a brush or a screen board may be employed. The area of the hair material where the dye is being applied is covered with a net member and then, a moisture-contained member such as moisturized nonwoven fabric or paper is wound over the area. Thereafter an evaporation adjusting member such as a sheet-like aluminum film or the like is wound over the previous application securing it. The dye is finally fixed to the hair material by a simple steam heating process.

A method of manufacturing colored hair according to the present invention will now be described.

In a process for manufacturing colored hair according to the first embodiment of the present invention, basically, a color sizing agent is directly applied to an area of hair material where a color to be applied is desired and the color sizing agent is permeated and fixed to the hair material by heated steam. This process is hereinafter referred to as a direct coloring process.

Firstly, a color applying step to the hair material will be described with reference to FIGS. 1 to 4.

The hair material, to which the present invention can be applied, may be an artificial hair made of a synthetic fiber such as nylon, modacryl, or a mixture thereof, a natural hair (human hair), a mixture thereof, or the like. Inasmuch as a color can be applied, the hair material can be selected from a wide range of materials. The previously mentioned hair materials may be preliminarily applied with a desired color such as black, red, silver, or the like.

Figure 4:
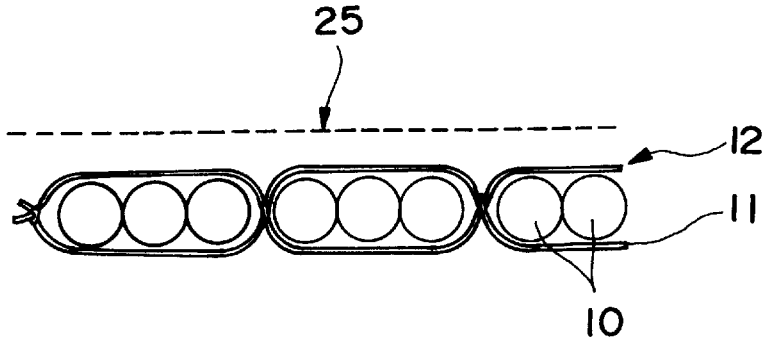
FIG. 4 is a cross section taken on line B—B in FIG. 1 along the center line of the hair bundle of FIG. 1.

As shown in FIG. 1, about 500 to 1000 strands of pre-cut hair material properly sized, for example, 30 to 80 cm are horizontally arranged in juxtaposed relation as one set and sewn together at the center in order to secure the unit, thus arranging to form a hair bundle 12 (FIG. 4 shows a sewn state of the hair material 10 in section).

The method for applying a color sizing agent to a desired part of the hair material 10 will now be described.

Figure 2:
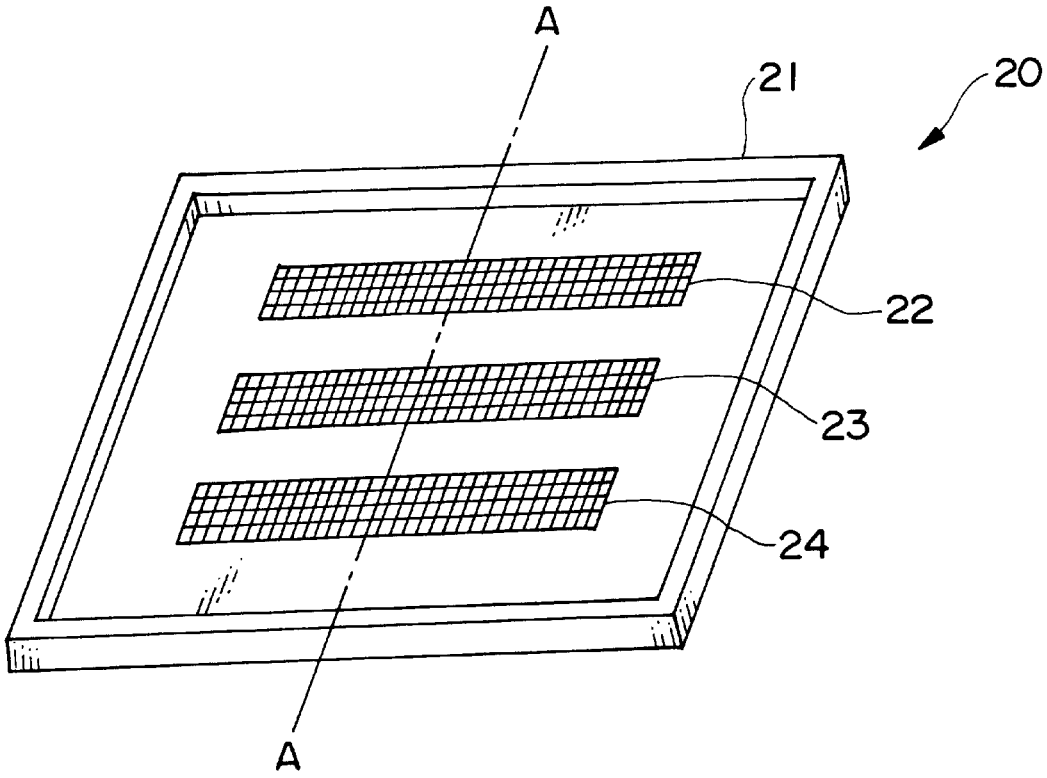
FIG. 2 is a perspective view of a screen board used in the process for manufacturing a colored hair according to the present invention.

Firstly, a screen board 20 is placed on the top of the hair bundle 12 sewn together with a sewing thread 11. FIG. 2 is a perspective view showing a construction of the screen board 20. As shown in FIG. 2, a proper number of rectangular screen windows 22, 23 are formed in a frame 21 of the screen board 20. By determining the number and position of the screen windows, the number of colors and the areas to be applied with colors are established. That is, by determining the dimension and the number of the screen windows, it can be established with respect to a single strand of hair material; the number of colors and areas to be applied with a color or colors, as well as the width of the areas in question. Likewise, depending on the location of each screen window, it can be determined; which part of a single strand of hair material is to be applied with a color or colors. Accordingly, in case the hair material as a whole is to be applied with the same color, it is enough to form a single large screen window. In the example of FIG. 2, three screen windows are formed, so that the respective areas 10*a*, 10*b*, 10*c* of the hair material 10 shown in FIG. 1 are applied with three different colors, such as, red, brown and yellow. Of course, the three areas of the single strand of hair material 10 may be applied with the same color. In this case, a colored hair in which the same color is intermittently applied to a single strand of hair material 10 can be obtained.

The screen windows 22, 23, 24 are formed with a fine mesh. Specifically, they are covered with a lattice-like net disposed between an upper and a lower frame 21 which are in a superimposed relation. If the thickness or boldness of the thread constituting the net is about 0.1 to 0.2 mm in diameter, and the size of the mesh is about 1.3 to 1.5 mm per each opening, i.e. about 1.6 to 2.3 $mm^2$ per opening in each mesh, the color sizing agent can be applied uniformly to the hair material 10 through the mesh.

In place of the screen board 20, the color sizing agent may be applied to the hair material 10 with a brush or the like, or sprayed thereto. If the screen board is used as in this embodiment, the parts (areas to be applied with the color sizing agent 25) 10*a*, 10*b*, 10*c* of the hair material which are required to be applied with color can be controlled in a correct manner. In addition, when combination colors are desired, for example, red to a specific area 10*a* of the hair material corresponding to the first screen window 22, brown to the area 10*b* located under the second window 23, and yellow to the area 10*c* located under the third window 24, the color sizing agent can be precisely applied to the predetermined areas quickly and easily.

Figure 3:
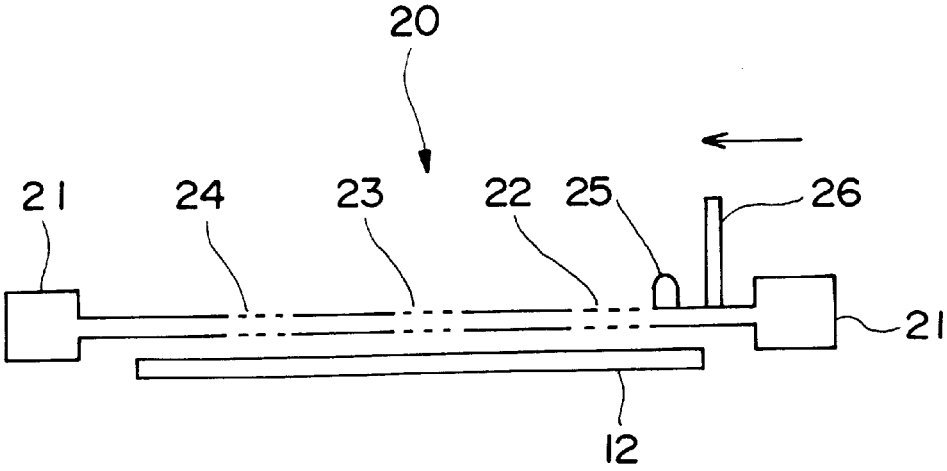
FIG. 3 is a cross section taken on line A—A in FIG. 2 when color is applied to the hair bundle placed on the screen board in accordance with the direct coloring process.

FIG. 3 is a cross section taken on line A—A in FIG. 2 when the screen board 20 is placed on the hair bundle 12. Referring to FIG. 3, the color sizing agent 25 is applied, for example, along the upper edge of the first screen window 22 and the color sizing agent is applied by spreading the color sizing agent 25 in a downward stroke application (direction as indicated by an arrow in FIG. 3) within the screen window 22 with a spatula 26. Normally, it is sufficient to apply the color sizing agent to only the surface of a single side of the hair bundle 12. However, in the case when the hair bundle 12 consists a multistage or overlapped structure due to its thickness, the color sizing agent is applied to the back side, as well.

The same or different color sizing agents 25 may be applied along the upper side edges of the screen windows 22, 23, 24. The agent or agents 25 may be applied in such a manner simply by spreading it the predetermined screen windows.

FIG. 4 is a cross section taken along the center line of the hair bundle 12. The hair bundle 12 is formed of hair material 10 already sewn. In the example of FIG. 4, the color sizing agent 25 is applied only to one surface of the hair bundle 12.

In case a modacryl-based synthetic fiber yarn is dyed as the hair material 10, the mixing ratio of the color sizing agent 25 is formulated at 76.8% by weight of water, 1.2% by weight of DL-malic acid (30% of aqueous solution), 5.8% by weight of carrier agent, 2.8% by weight of dye (cation dye), and 13.4% by weight of sizing agent generally used for dyeing carboxymethyl cellulose, etc.

If the DL-malic acid (30% of aqueous solution) is 1.2% by weight, the color sizing agent becomes acid and the dye is activated to enhance its fixation to the hair material. In this embodiment, the DL-malic acid is added so that the pH in the color sizing agent can be increased towards the acid side. This enhances the color development of the dye permeated and fixed to the hair material, thus providing a clear color shade. Other chemicals, which exhibit acid properties, may also be used. For example, if an acid smell should remain in hair after the color application treatment is carried out using acetic acid, formic acid, hydrochloric acid, or the like, the hair is preferably subjected to a deodorizing treatment.

After the color sizing agent 25 is applied to the hair bundle 12, the hair bundle 12 is combed and the hair bundle 12 thus applied with color is rolled up in the direction as indicated by an arrow X in FIG. 1. By rolling up the hair bundle 12, if a non-uniform coating occurs, it will be corrected by this method. Furthermore, by rolling up the hair material into a bundle in this way, additional space is not required when drying and heating is performed in the following steps.

Subsequently, the rolled up hair bundle 12 is hung on a pole or the like and then it is left at room temperature until the areas 10*a*, 10*b*, 10*c* of the hair bundle 12 applied with the color sizing agent 25 are semi-dried. At that time, attention is paid so that the areas 10*a*, 10*b*, 10*c* of the hair material will not contact other substances. If those areas should come in contact with outside substance(s), the color sizing agent of the area or areas which happen to contact other substance (s) is easily faded. The best drying condition for this purpose is the semi-drying technique. If the color sizing agent applied area or areas should be fully dried, it would become difficult to fully permeate and fix the dye to the hair material 10 at the steam heating stage of the following step.

The permeating and fixing steps of the color sizing agent 25 to the hair material 10 will now be described with reference to FIGS. 5 and 6.

After the color sizing agent applied to the hair bundle 12 is semi-dried as discussed above, the vapor feeding member 30 consisting of the net member 31 and the moisture-contained member 32, and the evaporation adjusting member 33 are, in order, wound around the treated areas 10*a*, 10*b*, 10*c* followed by applying a small amount of tensile force (pressure) to the hair material. If the vapor feeding member 30 and the evaporation adjusting member 33 should be wound around an area applied with no color sizing agent, a color change or fading tends to occur in the part not treated and therefore, the color of the original hair material would be changed. To avoid this, the wrapping is only utilized on the area where a color is to be applied.

Figure 5:
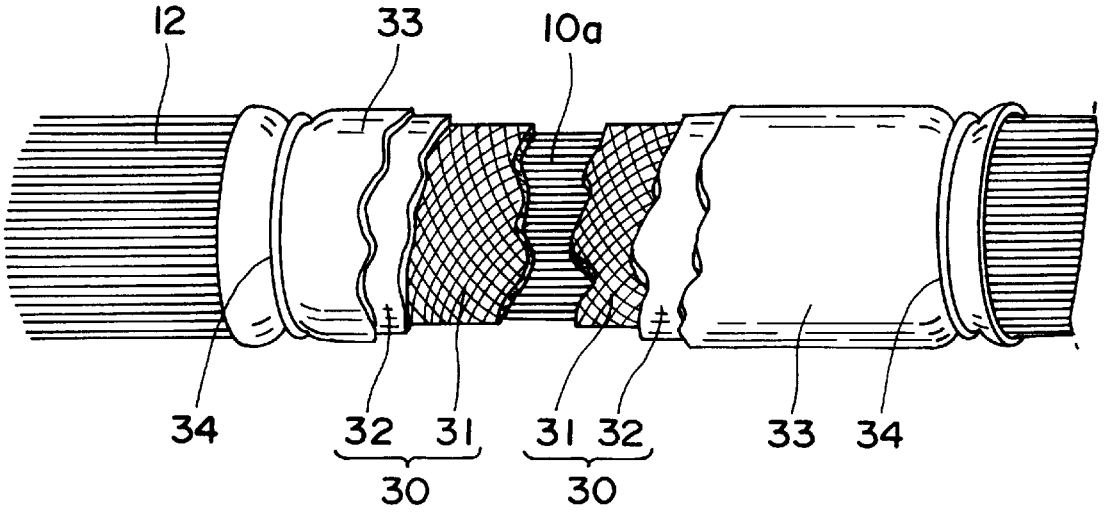
FIG. 5 is a perspective view, partly cutaway, showing a state in which the hair bundle is covered with respective members in order in accordance with the direct coloring process of the present invention.

FIG. 5 is a perspective view, partly cutaway, showing the area 10*a* of the hair bundle 12 wound around by the above respective members 30 and 33.

In this embodiment, the net member 31 and the moisture-contained member 32 constituting the vapor feeding member 30 are separately formed. However, they may be preliminarily integrally formed by, for example, sewing or bonding the moisture-contained member 32 to outside the net member 31.

Examples of the material of the net member 31 may include a raw material formed of a water repellent fiber made of synthetic resin or natural resin, in which the fiber constituting the net is about 0.1 to 0.15 mm in diameter, each mesh size is about 0.5 to 2 mm, preferably, about 0.8 to 1.5 mm, i.e. about 0.25 to 4.0 $mm^2$ per opening in each mesh, preferably, about 0.64 to 2.25 $mm^2$ per opening in each mesh.

The moisture-contained member 32 is wound around the net member 31 which is wound around the hair bundle 12. It is favorable that this moisture-contained member 32 is formed of a material capable of retaining moisture and containing an appropriate amount of moisture, such as a nonwoven fabric, paper, or a water absorptive synthetic resin formed into a sheet-like configuration, a water absorptive natural fiber woven into a cloth-like material. The moisture-contained member 32 is disposed on the net member 31 instead of being directly wound around the hair bundle 12 because if the moisture-contained member 32 should be wound directly around the hair bundle 12, the color sizing agent 25 is transferred to the nonwoven fabric, paper, or the like, and a desired color cannot be obtained, and it becomes difficult to avoid the nonwoven fabric, paper, or the like from being inadvertently adhered to the hair bundle in the following stage. The water content of the nonwoven fabric, paper, or the like is preferably set to about 1 to 1.5 g against 1 g of nonwoven fabric, paper, or the like.

Subsequently, the evaporation adjusting member 33 is wound around the vapor feeding member 30 consisting of the net member 31 and the moisture-contained member 32. This evaporation adjusting member 33 is preferably a film-like or sheet-like aluminum foil or a synthetic thin sheet, for example, which has excellent heat resisting properties, high in thermal conductivity, and excellent in sealability. After the evaporation adjusting member 33 is wound around the outermost layer of the hair bundle 12, which is already wound around by the net member 31 and the moisture-contained member 32 in that order, both ends of the hair bundle 12 to be applied with the color sizing agent are bound with a suitable fixture 34 such as a rubber band, a clip, or the like in accordance with necessity. This arrangement is made so that the moisture contained in the vapor feeding member 30 will not evaporate before its time. Accordingly, if the hair bundle 12 is firmly rolled the amount of evaporated vapor is minimized, thus the procedure of binding both ends of the color sizing agent applied area is not necessary.

The evaporation adjusting member 33 may be formed of material other than aluminum foil inasmuch as the material is capable of adjusting to the evaporation of vapor, as well as having heat resistance capability and excellent thermal conductivity. A certain degree of sealability must be maintaind when wound around the hair bundle 12 as discussed above. For example, a synthetic resin sheet such as polyurethane having flexibility and whose softness is 100° C. or more, can also be favorably used.

Figure 6:
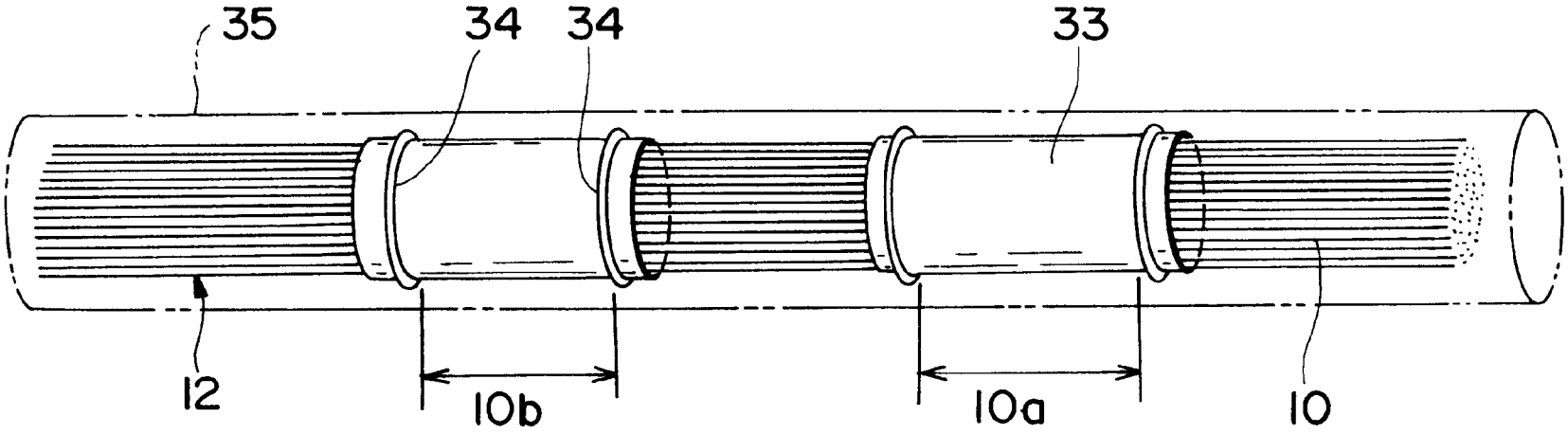
FIG. 6 is a perspective view showing the hair bundle of FIG. 5 further covered with a heat shielding member.

FIG. 6 is a perspective view showing an example of a heating stage when a color is applied to two areas 10*a*, 10*b* of the hair material 10. Both ends of each evaporation adjusting member 33 are in an open state and are held in place by fixtures 35.

If the opposite ends of the evaporation adjusting member 33 should be in a sealed state, the steam generated from the moisture contained in the moisture-contained member 32 would be unable to find a way to escape when the heating treatment operation process is engaged in order to permeate and fix the dye to the hair material 10, with the result that the steam in the evaporation adjusting member 33 is overly saturated and the permeating and fixing operation of the dye is jeopardized.

Accordingly, in the case when opposite ends of the film-like aluminum foil are brought into a sealed state, it is preferred that fine holes (not shown) be formed in the aluminum foil film with a needle, or the like, in that a steam release function will be obtained.

The reason as to why the moisture-contained member 32 formed of nonwoven fabric or paper is wound and followed by the application of the evaporation adjusting member 33 made of aluminum foil film is wound around the previous mentioned layer is to create a steam atmospheric condition that can be easily created.

Subsequently, the heat shielding material 35 (see FIG. 6), formed of nonwoven fabric or paper, is wound around the entire hair bundle including the area where the color sizing agent is not to be applied in order to cut off the heat while the heating treatment undergoes.

At this point, the hair bundle 12 is placed into a drier or an oven (not shown) and heated at a temperature ranging from 80 to 110° C. for a prior of 1 to 2 hours. Upon completion, the hair bundle is removed from the drier or the oven and left in that state until reaching room temperature or so. It is at this stage that the step for permeating and fixing the color sizing agent to the hair material 10 is completed.

Lastly, the heat shielding material 35, evaporation adjusting member 33, and vapor feeding member 30 consisting of the net member 31 and moisture-contained member 32 are all sequentially removed from the hair bundle 12. Finally, the hair bundle and the unfixed color sizing agent adhered to the surface of the hair material 10 is washed in order to remove excess. This washing procedure is repeated until the washing bath becomes transparent.

After washing, the hair is then dried. The thread 11 sewn in the central portion of the hair bundle 12 is then detached to allow the hairs to return to their initial loosened or separated states. By doing so, strands of partly colored hairs are obtained.

The colored hair thus obtained is implanted in the base of a wig or used as hair thickening material. In another application, the colored hair thus obtained can also be attached to hair on a person's head as false hair for fashion reasons.

According to the direct color applying process for the hair material of the present invention, the overall hair material from its basal end to its distal end can of course be dyed the same color. Also, only a lengthwise desired part or area of the hair material can be dyed easily. Moreover, if color sizing agents are applied to the hair material from its basal end to its distal end gradually at desired intervals, there can be obtained a partly colored hair having a rich fashionability, in which color shades are intermittently applied to a single strand of hair.

Furthermore, in the case when the hair material is used as hair for a wig, or as hair thickening material, normally, the hair material is folded in half at its center point, and then the center point of the hair material is jointed to the base of the wig or at the basal end portion of the hair on a person's head. If this central portion is dyed using a color sizing agent having a similar color to that of the wig base or scalp, the knot becomes less-conspicuous and thus, colored hair having an excellent camouflage effect can be obtained.

Next, the indirect color applying process according to the present invention will now be described.

In this indirect color applying process, hair material is wrapped with a transfer sheet applied with dye and then dried. It is then heated under vapor, with the use of a steam iron, for example, from the top of the transfer sheet, so that the dye is permeated and fixed to the hair material.

In case the dye is permeated and fixed to the hair material employed by the indirect color applying process according to the present invention, as shown in FIG. 5, it is most convenient to use a screen board of the same structure as that which is used in the above direct color applying process.

Figure 7:
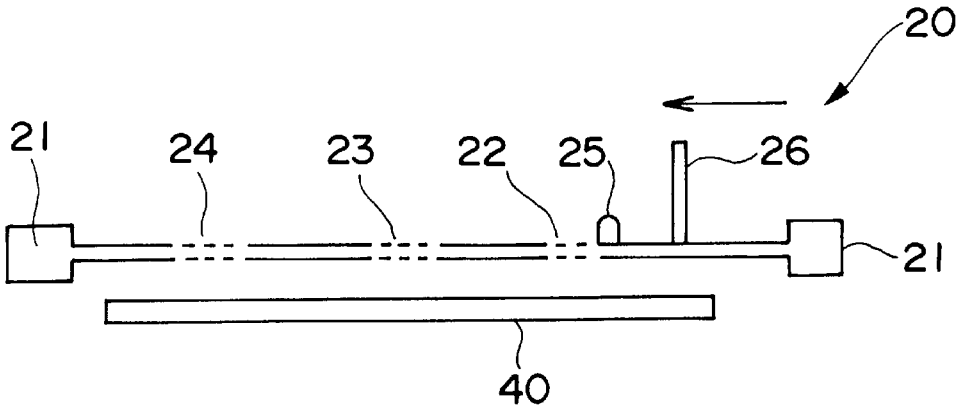
FIG. 7 is a cross section showing the screen board placed on a transfer sheet in accordance with the indirect coloring process of the present invention.

FIG. 7 is a cross section showing the screen board 20 placed on the transfer sheet 40. Screen windows 22, 23, 24 having a suitable number and size are formed in the screen board 20 and a fine mesh is positioned. The boldness or thickness of the thread constituting the mesh, i.e. the thread constituting the net is preferably about 0.1 to 0.2 mm in diameter, and the size of the open mesh is preferably about 1.3 to 1.5 mm for each opening (i.e. about 1.69 to 2.25 $mm^2$ per opening in each mesh) as in the screen board used in the direct color applying process. The number of openings per one square inch is approximately 1000.

The color sizing agent 25 is applied to the upper side of the screen window 22 after the screen board is placed on the transfer sheet 40. Then, the color sizing agent 25 is spread in a downward stroke (direction as indicated by an arrow in FIG. 7) with the use of a spatula 26 so as to be applied to the top surface of the transfer sheet 40.

As the transfer sheet 40 herein used, newspaper, copy paper, other ordinary paper, cloth, or the like is acceptable. The material is not particularly limited inasmuch as the surface of the paper is not subjected to a water repellent treatment. The mixing ratio of the color sizing agent may also be the same as in the above direct color applying process.

Figure 8:
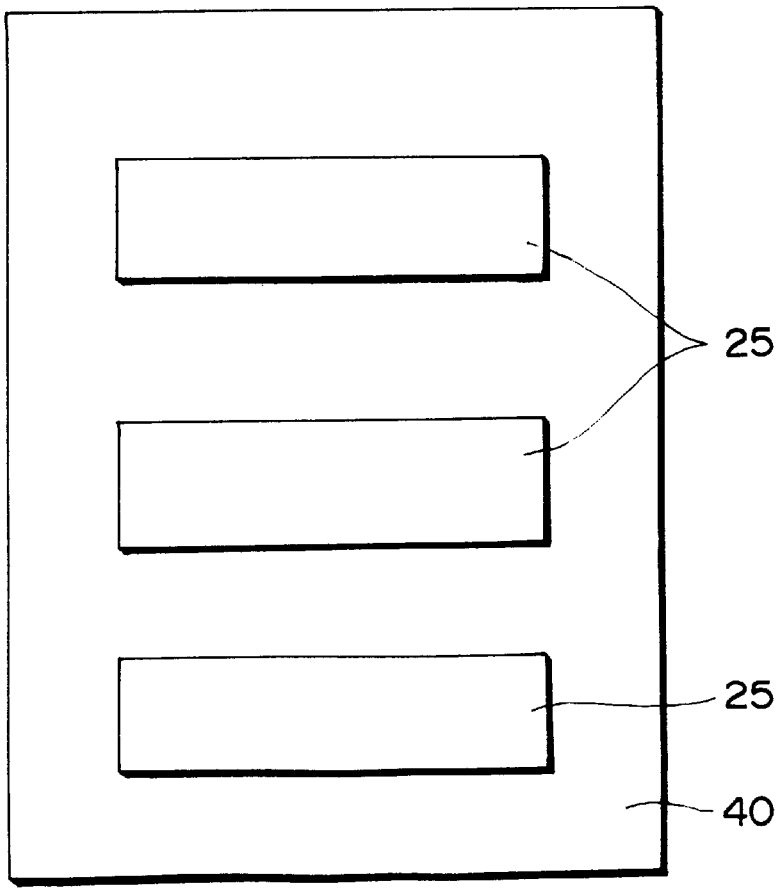
FIG. 8 is an front elevational view showing the transfer sheet applied with a color sizing agent.

After the color sizing agent 25 is applied to the surface of the transfer sheet 40, the agent 25 is completely dried. FIG. 8 is an outer view showing the color sizing agent 25 of a desired color applied to the surface of the transfer sheet 40.

Figure 9:
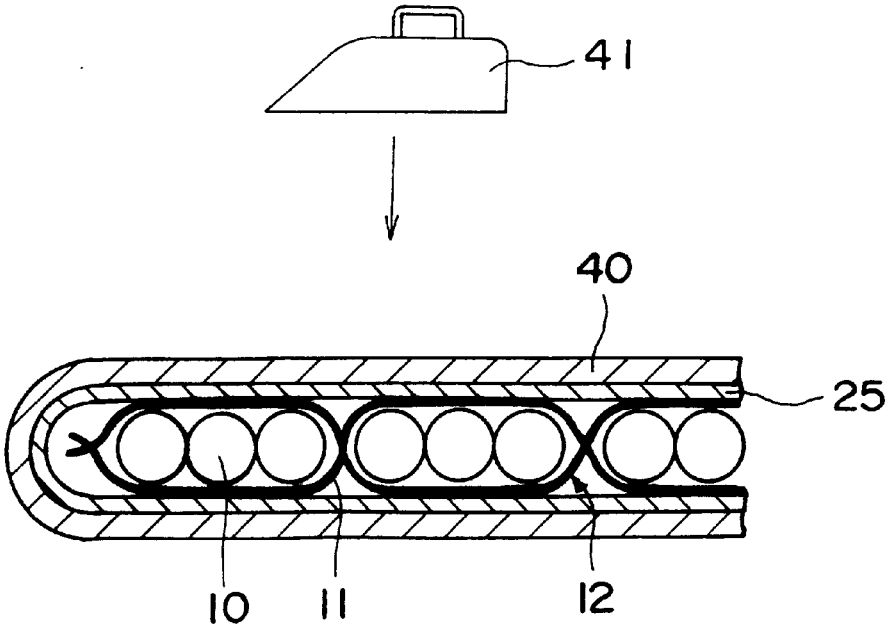
FIG. 9 is a cross section showing the hair bundle covered with the transfer sheet and heated by a steam iron.

After dried, the hair bundle 12 bundled by using only the sewing thread 11 is wrapped in such a way that the area desired to be applied with color is in direct contact with the area of the transfer sheet 40 where the color sizing agent 25 is to be applied. FIG. 9 is a cross section showing the hair bundle 12 wrapped up with the transfer sheet 40 itself.

After the hair bundle 12 is wrapped up, a handy type steam iron 41, for example, is pressed from the top surface of the transfer sheet 40 as shown in FIG. 9 under vapor, so that the color sizing agent 25 is permeated and fixed to the hair material 10. In this way, by projecting a heated vapor to the color sizing agent 25, the color sizing agent, once dried, is eluted so as to be permeated into the hair material 10. The temperature of the steam iron 41 is preferably set from 80 to 85° C. With respect to the pressure to be used with the steam iron 41, for example, after the steam iron is pressed on a single surface of the transfer sheet 40 for about 30 seconds, the process is then repeated on the other surface for the same time period. This procedure is repeated twice. By doing so, the permeating and fixing operation of the color sizing agent 25 to the hair material 10 is completed.

Then, the hair bundle 12 is removed from the wrapped transfer sheet 40 and washed in order to remove the non-fixed color sizing agent adhered to the surface of the hair material. At that time, the washing is repeated until the rinse cycle becomes transparent.

After washing and dried, the sewing thread 11 of the hair bundle 12 is removed, and the hair material 10 is brought back into its initial separated state. Then, by combing, a partly colored hair can be obtained. The colored hair thus obtained is implanted in the base of a wig or used as hair thickening material. In another application, it can be attached to hair on a person's head as false hair for fashion.

According to the process for manufacturing directly- or indirectly- colored hair according to the present invention, even in the case when two or more colors or color shades are to be applied to a single strand of hair material, color sizing agents are applied respectively to predetermined areas of the hair material and then heated under a steam state after the application of the color sizing agent is completed. In doing so, the permeating and fixing work of the dye can be done in one step. Accordingly, the total number of working steps can be reduced extensively.

Since the process for manufacturing colored hair according to the present invention is basically such that color is partly applied to a hair bundle and then permeated and fixed, shades or different colors can be applied to a single strand of hair without the need of major facilities.

Moreover, by applying color in accordance with the present invention, color can correctly be applied to a predetermined area of the hair material and in addition, the demand for a specific product can be met regardless of the number requested.

The most preferred embodiment of the present invention has been described with reference to a case where a color is applied to a modacryl-based hair material for a wig using a cation dye and a sizing agent generally used for dyeing. It should be noted, however, that an acid dye is used for human hair as well as nylon-based artificial hair, while a dispersing dye is required for polyester-based artificial hair. Acetophenone, benzyl alcohol, or the like can be used as the carrier agent, i.e., the agent used for enhancing an application of color.

In the case when color is applied using human hair and nylon as hair material, the procedure is generally the same as in the case of the above-mentioned modacryl-based hair material. For example, the mixing ratio of the color sizing agent 25 is formulated to 75.4% by weight of water, 2.6% by weight of DL-malic acid (30 % of aqueous solution), 5.0% by weight of coloring enhancing agent (salt or sodium sulfate), 2.8% by weight of dye (acid dye), 13.4% by weight of sizing agent generally used for dyeing carboxymethyl cellulose, or the like, and 0.8% by weight of a swelling agent (nonion-based surface active agent). A hair bundle 12 applied with a color sizing agent is thus adjusted and finished through the predetermined procedure. It is then put into a drier or an oven (not shown) and heated from 90 to 100° C. for about 1 to 1.5 hours. Once completed, the hair bundle is removed from the drier or the oven and left in it's present state until cooled to approximately a room temperature. By doing so, the permeating and fixing process of the color sizing agent to the hair material 10 is completed.

In the case when polyester fiber is used as the hair material, the mixing ratio of the color sizing agent is formulated, for example, to 75.6% by weight of water, 2.4% by weight of pH adjusting agent (sodium acetate), 5.8% by weight of coloring enhancing agent (benzyl alcohol, or acetophenone), 2.8% by weight of dye (dispersing dye), and 13.4% by weight of sizing agent generally used for dyeing carboxymethyl cellulose, or the like. Then, the hair bundle 12 is put into a drier or an oven in the same manner as mentioned above and heated at 120 to 130° C. for about 1 to 1.5 hours, for example. Upon completion, the hair bundle is removed from the drier or the oven and left in it's present state until cooled to approximately a room temperature. By doing so, the permeating and fixing process of the color sizing agent to the hair material 10 is completed.

Hair material to be subjected to color treatment according to the present invention should not be limited to those which are not yet applied with a color or colors, but may also include those which have already been applied with a color or colors using pigment or dye. In other words, even over an existing color or colors, an additional color or colors can be applied according to the method of the present invention.

Figure 10:
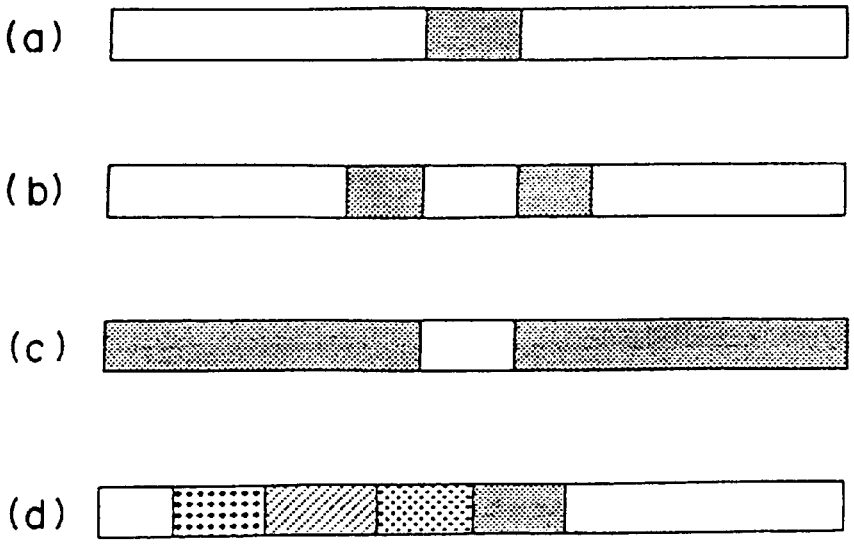
FIG. 10 is a view showing a pattern of an area of a single strand of hair where color is applied according to the present invention.

FIG. 10 is a view showing a pattern of the area of a single strand of hair to be applied with color.

As shown in FIG. 10(*a*), in the process for manufacturing a colored hair according to the present invention, part of a single strand of hair can be applied with a color, or as shown in FIG. 10(*b*), colors can be spaced and applied in shades or colors can be freely applied in a gradual spectrum. Also, as shown in FIG. 10(*c*), a single strand of the entire hair material, exempting only the center which is transparent, is applied with color. In this case, if the non-color applied area at the central area is transparent, for example, this area is folded into two and implanted to a base of a wig or directly jointed to hair on a person's head. By doing so, the knot portion becomes less-conspicuous and the camouflage effect at the root portion is fully exhibited. The color to be applied is not limited to one color. As shown in FIG. 10(*d*), a color(s) can be applied to plural areas of a single strand of hair. Moreover, the color can be applied not only entirely but strategically.

When the hair material is applied with plural or various colors, and if the screen board is used as in this embodiment, the area of the hair material to be applied with color can be precisely controlled. In addition, for example, the area corresponding to the first screen window 22 is applied with red, the area located under the second window 23 is applied with brown, and the area located under the third window 24 is applied with yellow. By doing so, a single strand of hair material in which three colors are intermittently applied can be obtained through a single step.

As understood from the description hereinbefore described, in the process for manufacturing a colored hair according to the present invention, even in the case when two or more colors are applied to a single strand of hair material, simply by applying a plurality of color sizing agents to the hair material and heating the same under vapor after the color application is completed, the step for permeating and fixing the dye can be executed in one step. Accordingly, the number of color application steps can extensively be reduced.

Furthermore, since the process for manufacturing a colored hair according to the present invention is basically such that color is partly applied to a hair bundle and then permeated and fixed, plural or various color shades(tones) can be applied to a single strand of hair without a need of a wide facility.

Moreover, by applying color in accordance with the present invention, color can correctly be applied to a predetermined area of the hair, and in addition, the demand for a specific product can be met regardless of the number requested.

Concerning colored hair of the present invention, since a single or two or more colors or color shades(tones) are applied to each strand of hair, the colored hair of the present invention can be used as a false hair for fashion.

Moreover, in the case when colored hair of the present invention is jointed to a wig or the hair on a person's head, the knot portion can be camouflaged by implanting a colored hair applied with a less-conspicuous color to the knot.

Obviously, numerous modifications and variations of the present invention are possible in light of the above techniques. It is therefore to be understood that within the scope of the appended claims, the invention may be practiced otherwise than as specifically described herein.

What is claimed is:

1. A process for manufacturing colored hair comprising the steps of:

applying a color sizing agent comprising a dye and a sizing agent to hair material;

semi-drying said color sizing agent applied to said hair material;

winding a vapor feeding member comprised of a net member and a moisture-containing member around an area of said hair material where said color sizing agent is applied;

winding an evaporation adjusting member for adjusting a quantity of evaporation of said moisture around said vapor feeding member from outside thereof; and permeating and fixing said color sizing agent to the color sizing agent applied area of said hair material by heating said vapor feeding member;

to obtain a desired color shade or desired color on at least part of an area of said hair material wherein said color sizing agent has been applied.

2. A process for manufacturing colored hair according to claim 1, wherein said hair material consists of artificial hair made of synthetic fiber selected from the group consisting of nylon, modacryl, and polyester, human hair, or mixtures thereof, and wherein plural strands of said hair material cut into a desired length dimension are placed in juxtaposed relation, then, a central portion of said plural strands of said hair material thus juxtaposed is sewn into a hair bundle, and then, a color sizing agent is applied thereto.

3. A process for manufacturing colored hair according to claim 1, wherein said color sizing agent contains 30% by weight of aqueous solution of DL-malic acid, and said DL-malic acid is contained in said color sizing agent in an amount of 1.2% by weight.

4. A process for manufacturing colored hair according to claim 1, wherein said color sizing agent is applied to said hair material with a screen board having a window, and said color sizing agent is applied to a predetermined area of said hair material through a fine mesh formed in said window.

5. A process for manufacturing colored hair according to claim 4, wherein said mesh formed in said window of said screen board is 1.6 to 2.3 $mm^2$ per opening in said mesh.

6. A process for manufacturing colored hair according to claim 1, wherein said net member of said vapor feeding member is separately constructed from, and surrounded by said moisture-containing member.

7. A process for manufacturing colored hair according to claim 1, wherein said net member of said vapor feeding member is integrated with, and surrounded by, said moisture-contained member by sewing or bonding.

8. A process for manufacturing colored hair according to claim 1, 6, or 7, wherein said net member is formed of synthetic resin fiber which is 0.1 to 0.15 mm in thickness and 0.25 to 4.0 $mm^2$ per opening.

9. A process for manufacturing colored according to claim 1, 6, or 7, wherein said moisture-containing member is formed of a nonwoven fabric sheet, a paper sheet, a water absorptive synthetic resin sheet, or a water absorptive natural fiber interwoven sheet, and said sheet contains moisture.

10. A process for manufacturing colored hair according to claim 1, wherein said evaporation adjusting member is formed of a film comprising aluminum foil, and said aluminum foil is firmly wound around said vapor feeding member, which covers the color sizing agent applied area of said hair material, from outside thereof, with opposite ends of said film comprising aluminum foil opened.

11. A process for manufacturing colored hair according to claim 1, wherein when said color sizing agent is permeated and fixed to the color sizing agent applied area of said hair material, a heat shielding material is wound around said hair material from outside said evaporation adjusting member, and thereafter, said hair material is heated.

12. A process for manufacturing colored hair according to claim 11, wherein said heat shielding material is made from nonwoven fabric or paper.

13. A process for manufacturing colored hair according to claim 1, wherein a plurality of spaced sections from the basal end to the distal end of said hair material are subjected to dyeing treatment by said color sizing agent.

14. A process for manufacturing colored hair according to claim 1, wherein a central area of said hair material is dyed in the same color as either a base of a wig or a scalp by applying said color sizing agent thereto.

15. A process for manufacturing colored hair, comprising the steps of:

applying a color sizing agent comprising a dye and a sizing agent to a transfer sheet which is permeable to water vapor and drying the same;

enclosing an area of hair material to be subjected to color treatment with an area of said transfer sheet where said color sizing agent is applied; and permeating and fixing said color sizing agent to said hair material by heating the color sizing agent applied area from the top of said transfer sheet with water vapor;

to obtain a desired color shade or desired color on at least part of an area of said hair material wherein said color sizing agent has been applied.

16. A process for manufacturing colored hair according to claim 15, wherein said color sizing agent contains 30% by weight of aqueous solution of DL-malic acid, and said DL-malic acid is contained in said color sizing agent in an amount of 1.2% by weight.

17. A process for manufacturing colored hair according to claim 15, wherein said color sizing agent is applied to said transfer sheet with a screen board having a window, and said color sizing agent is applied to said transfer sheet through a fine mesh formed in said window.

18. A process for manufacturing colored hair according to claim 17, wherein said mesh formed in said window of said screen board is 1.6 to 2.3 $mm^2$ per opening in said mesh.

19. A process for manufacturing colored hair according to claim 15 wherein said hair material is partly dyed in a plurality of different colors or color shades by application of said color sizing agent.

* * * * *